United States Patent [19]

Germann

[11] Patent Number: 5,042,378

[45] Date of Patent: Aug. 27, 1991

[54] COMBINED SHEET-FED ROTARY PRINTING MACHINE FOR SECURITIES, ESPECIALLY BANKNOTES

[75] Inventor: Albrecht J. Germann, Wurzburg, Fed. Rep. of Germany

[73] Assignee: De La Rue Giori S.A., Lausanne, Switzerland

[21] Appl. No.: 378,174

[22] Filed: Jul. 11, 1989

[30] Foreign Application Priority Data

Jul. 13, 1988 [CH] Switzerland ..... 2662/88

[51] Int. Cl.[5] ..... B41F 5/16; B41F 9/02; B41F 11/00

[52] U.S. Cl. ..... 101/152; 101/177; 101/DIG. 49

[58] Field of Search ..... 101/175, 176, 177, 183, 101/184, 220, 221, 222, 223, 217, 152, 136, 137, 142, 424.1, DIG. 49

[56] References Cited

U.S. PATENT DOCUMENTS 4,584,939 4/1986 Giori ..... 101/179

4,697,515 10/1987 Germann ..... 101/179

*Primary Examiner*—J. Reed Fisher

*Attorney, Agent, or Firm*—Kane Dalsimer Sullivan Kurucz Levy Eisele and Richard

[57] ABSTRACT

The printing machine is composed of an indirectly printing printing unit (A), and a sheet transport device (B), composed solely of drums (18, 19, 20, 22, 23, 24), and of a following intaglio printing unit (C). The indirectly printing printing unit (A) has two interacting blanket cylinders (3, 5), each of which is inked with several colors by several plate cylinders (12, 15; 7, 10). The sheets are passed onto one of the blanket cylinders (3) from a carry-over drum (2) and, after passing through the nip between two blanket cylinders (3, 5), thereby being printed on both sides, are taken over by a transfer drum (18) of the sheet transport device. The circumferential region which is located between the carry-over drum (2) and transfer drum (8) and over which the sheet passes extends over at most 180°, preferably less than 150°, so that that free circumferential region of this blanket cylinder not covered by the sheet is available for accommodating several plate cylinders.

11 Claims, 6 Drawing Sheets

COMBINED SHEET-FED ROTARY PRINTING MACHINE FOR SECURITIES, ESPECIALLY BANKNOTES

FIELD OF THE INVENTION

The invention relates to a combined sheet-fed rotary printing machine for securities, especially banknotes, according to the preamble of patent claim 1.

PRIOR ART

A printing machine of this type is described in EP-B-0,136,972. The indirectly printing printing unit of this known printing machine is composed of a blanket cylinder inked by several offset plate cylinders and of an impression cylinder interacting with this and therefore makes it possible for only one of the sheet sides to be printed. A carry-over drum and transfer drum interact with the impression cylinder, the sheet grippers of which take over a sheet from the carry-over drum and take it along, with it resting against the circumference of the impression cylinder, until it is grasped by the grippers of the transfer drum. In this arrangement the circumferential region which is located between the carry-over drum and transfer drum and in which the sheet is taken up on the impression cylinder is substantially larger than half the circumference of the impression cylinder. Furthermore, the transfer drum functions at the same time as a sheet-turning drum of a sheet-turning device and for this reason has a size corresponding to the length of two sheets, so that its diameter is twice as large as the diameter of the plate cylinders and of the carry-over drum which conventionally have a size corresponding to a single sheet, whilst the blanket cylinder and the impression cylinder are matched to the format of three sheets and consequently have three times as large a diameter as the plate cylinders and the carry-over drum.

In the known combined printing machine, the sheet transport device is composed, as mentioned, of a sheet-turning drum interacting with the impression cylinder of the indirectly printing printing unit and functioning as a transfer drum, of a small drum belonging to the sheet-turning device and matched to the size of a sheet, of a drying drum of double the size, in the circumferential vicinity of which is arranged a drying device, of a register drum correcting the register and of a transport drum which transfers the sheets onto the impression cylinder of the intaglio printing unit and of which the size, like the size of the register drum, corresponds to the size of a sheet. Since this transport device, abandoning chain-gripper systems, works only with interacting drums in which the sheet passes directly from one drum onto the following drum, a perfect register is maintained with a high degree of reliability during the entire sheet transport between the indirectly printing printing unit and the intaglio printing unit, so that, in general, a possible register correction becomes necessary, at most, after a sheet turn and then is carried out automatically by the register drum.

With the known printing machine mentioned, without the sheets being turned either one and the same sheet size can be printed with a multicolor offset print and with a multicolor steel intaglio print or, with the sheet being turned, one sheet side acquires a multicolor offset print and the other sheet side a multicolor steel intaglio print.

SUMMARY OF THE INVENTION

The object on which the present invention is based is to design a combined sheet-fed rotary printing machine of the type described in the preamble of claim 1, whilst preserving a sheet transport device composed only of drums, in such a way that the indirectly printing printing unit can work by recto-verso printing and a multicolor image can be produced on each of the two sheet sides.

This object is achieved by means of the features indicated in the defining clause of claim 1.

As a result of the design and arrangement of the carry-over drum and of the transfer drum in the indirectly printing printing unit, that free circumferential region of the second cylinder designed as a blanket cylinder which is not covered by a sheet is enlarged to such an extent that several, especially three or four offset plate cylinders and their inking units can be installed along this circumferential region, so that a sheet passing through the indirectly printing printing unit receives in each case a multicolor print in a simple way not only on its side confronting the first blanket cylinder, but also on the side resting against the second blanket cylinder. Where banknotes are concerned, these multicolor prints are preferably each a multicolor safety background which is completed in the intaglio printing unit, on one sheet side, by a multicolor steel intaglio print representing the main design. Thus, with this printing machine it is possible, in one operation, to produce complete banknote prints, in which the front side has a multicolor main design and a multicolor safety background and the rear side has a multicolor safety background, as is often customary especially on banknotes of low values. Furthermore, however, a main design can also be produced on the rear side if at least one of the plate cylinders of the indirectly printing printing unit is equipped with a wet-offset printing plate, preferably in the form of a dampened intaglio printing plate, which has a main design.

Expedient embodiments of the printing machine according to the invention emerge from the dependent claims. An especially expedient embodiment, according to which the indirectly printing printing unit is convertible and, depending on the setting, makes it possible to produce a multicolor offset print or a multicolor collect print on one sheet side, is described in claim 11.

BRIEF DESCRIPTION OF THE DRAWINGS

The invention is explained in detail by means of exemplary embodiments with reference to the drawings. In these.

DESCRIPTION OF THE PREFERRED EMBODIMENTS

Figure 1:
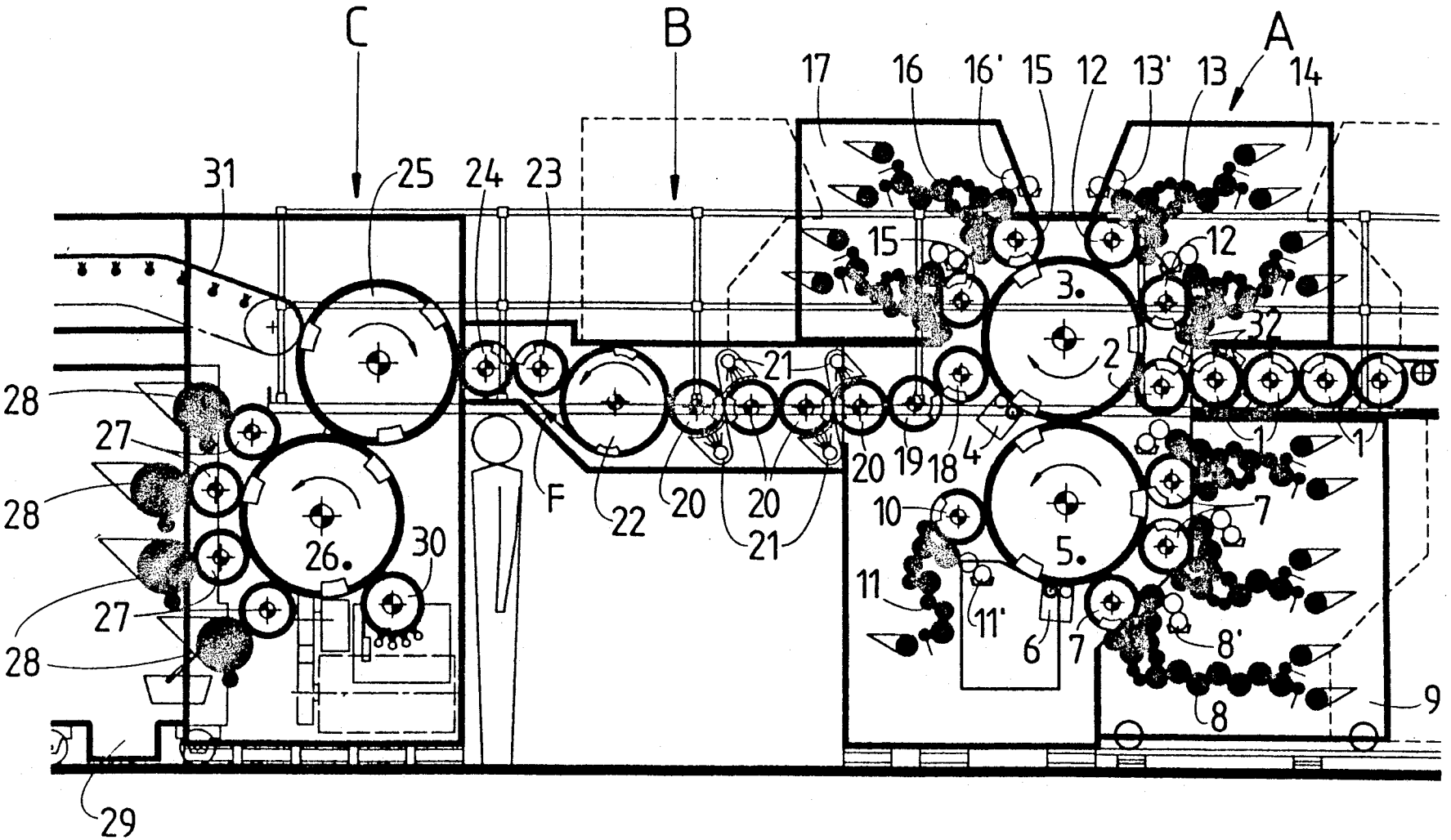
FIG. 1 shows a first exemplary embodiment of a combined sheet-fed rotary printing machine, in which the indirectly printing printing unit provides a multicolor offset print on both sides.

According to FIG. 1, the combined sheet-fed rotary printing machine is composed of an indirectly printing printing unit A which the sheets run through first, of a following sheet transport device B, composed solely of drums. and of an intaglio printing unit C, into which the sheets pass at the end of the transport device B.

The indirectly printing printing unit A, which is a printing unit working by recto-verso printing, has two interacting blanket cylinders 3 and 5 arranged vertically above one another, which are each in touch with several plate cylinders 12, 15 and 7, 10 carrying offset printing plates and between which the sheets are printed simulataneously on both sides. Via several transport drums 1 and a carry-over drum 2 interacting with the blanket cylinder 3, the sheets pass onto the blanket cylinder 3, by the sheet grippers of which they are taken up. The direction of rotation of the two blanket cylinders 3 and 5 is indicated by arrows. After a sheet taken up by the blanket cylinder 3 has passed the printing point between the two blanket cylinders, it is grasped by a transfer drum 18 which interacts with the blanket cylinder 3 and which forms the first transport drum of the sheet transport device B. The circumferential region which is located between the carry-over drum 2 and the transfer drum 18 and in which a sheet is taken up by the blanket cylinder 3 is at most as large as half the circumference of the latter and, in the example under consideration, extends over approximately 135°. In general, it is advantageous if this circumferential region extends over an angle of less than approximately 150°.

The transfer drum 18 has the same diameter as the carry-over drum 2 and the plate cylinders 7, 10 and 12, 15 which, as is conventional, are small cylinders which carry only one printing plate and the circumferential length of which is matched to the size of a sheet. The blanket cylinders 3 and 5 are each intended for receiving three sheets and are therefore three times as large.

With the arrangement and design of the carry-over drum 2 and of the transfer drum 18, that free upper circumferential region of the blanket cylinder 3 not covered by a sheet is at least as large as half the cylinder circumference; in the example under consideration, it extends over approximately 225° and provides sufficient space for accommodating several plate cylinders, in the example under consideration four plate cylinders, of which, according to FIG. 1, the two plate cylinders 12 are arranged on the right of the vertical center line and the two plate cylinders 15 on the left of the vertical center line of the blanket cylinder 3.

It is assumed in the example under consideration that the plate cylinders 12 and 15 carry wet-offset plates. These are each inked by an inking unit 13 and 16 and each dampened by a dampening unit 13' and 16'. The inking units 13 and the dampening units 13' are accommodated in an inking-unit stand 14, and the inking units 16 and dampening units 16' are accommodated in an inking-unit stand 17.

The other blanket cylinder 5 interacts with plate cylinders which carry four offset printing plates and of which, according to FIG. 1, three plate cylinders 7 are installed on the right of the vertical center line and one plate cylinder 10 is installed on the left of the vertical center line of the blanket cylinder 5. It is assumed, once again, that these plate cylinders carry wet-offset plates. The three plate cylinders 7 interact with inking units 8 and dampening units 8' in a removable inking-unit stand 9, whilst the plate cylinder 10 interacts with an inking unit 11 and a dampening unit 11'.

Furthermore, according to FIG. 1, in the circumferential vicinity of the carry-over drum 2 and of the preceding transport drum 1 there are fluff suck-off devices 32; these suck-off devices acting on one sheet side and the other can also be arranged in circumferential proximity to at least two successive transport drums 1. Moreover, in the lower circumferential region of the blanket cylinder 3 and of the blanket cylinder 5 there are automatically working blanket-washing devices 4 and 6 which, of course, during the printing operation of the printing unit assume an inoperative position moved away from the blanket cylinders.

In the example under consideration, the transport device B has nine transport drums, specifically the transfer drum 18, a drum 19, four drums 20, in circumferential proximity to which drying devices 21 are arranged for the drying of the two printed sheet sides, a sheet-turning drum 22 belonging to a sheet-turning device, a drum 23 functioning as a register drum and at the same time as part of the sheet-turning device, and a further drum 24 which introduces the sheets into the intaglio printing unit C. The drums 18, 19, 20, 23 and 24 all have the same size matched to one sheet, whilst the sheet-turning drum 22 is matched to the size of two sheets and therefore has twice as large a diameter.

This sheet-turning device is known and its functioning is explained, for example, in EP-B-0,136,972. If a sheet located on the drum 22 rotating in the direction of the arrow is not to be turned, it is taken over directly by the drum 23 in the usual way, the grippers of the latter grasping the front edge of the sheet arriving on the drum 22. If a sheet turn is to take place, the sheet, after passing completely through the nip between the drums 22 and 23, is grasped at its rear edge by the grippers mounted pivotably on the drum 23 and controlled correspondingly and is drawn onto the drum 23 in the direction of the straight arrow F, the previous rear edge of the sheet becoming the front edge of the sheet which is released simultaneously by the grippers of the drum 22.

The drum 23, in its function as a register drum, ensures that possible deviations of the sheet positions from the exact register are corrected. Such a system for register correction and its functioning are described in the said EP-B-0,136,972.

In the example according to FIG. 1, all the drums of the transport device B, the carry-over drum 2 and the transport drums 1 arranged in front of it are located at least approximately horizontally next to one another or in a horizontal plane.

The intaglio printing unit C is composed of an impression cylinder 25, onto which the sheets pass from the transport drum 24, of a plate cylinder 26 interacting with the impression cylinder 25 and carrying intaglio printing plates, of four stencil rollers 27 which are inked with different colors by inking units 28 and which ink the intaglio printing plates on the plate cylinder 26, and of a wiping device 30. All the inking units 28 are installed in a removable inking-unit stand 29. The sheets printed in the intaglio printing unit C are subsequently received by a transport system 31, especially a chain-gripper system.

With the printing machine described, banknotes can be provided on each of the two sides with a four-color offset print representing a safety background and, moreover, depending on the setting of the sheet-turning device, on one side with a four-color steel intaglio print as a main design. If appropriate, the other sheet side can also be provided with a main design in the printing unit A, this purpose then being served by one of the plate cylinders which, in this case, is preferably equipped with an intaglio printing plate which has a main design and of which the surface outside the depressions is dampened by the corresponding dampening unit, so that it does not receive any color during the inking of the printing plate.

Figure 2:
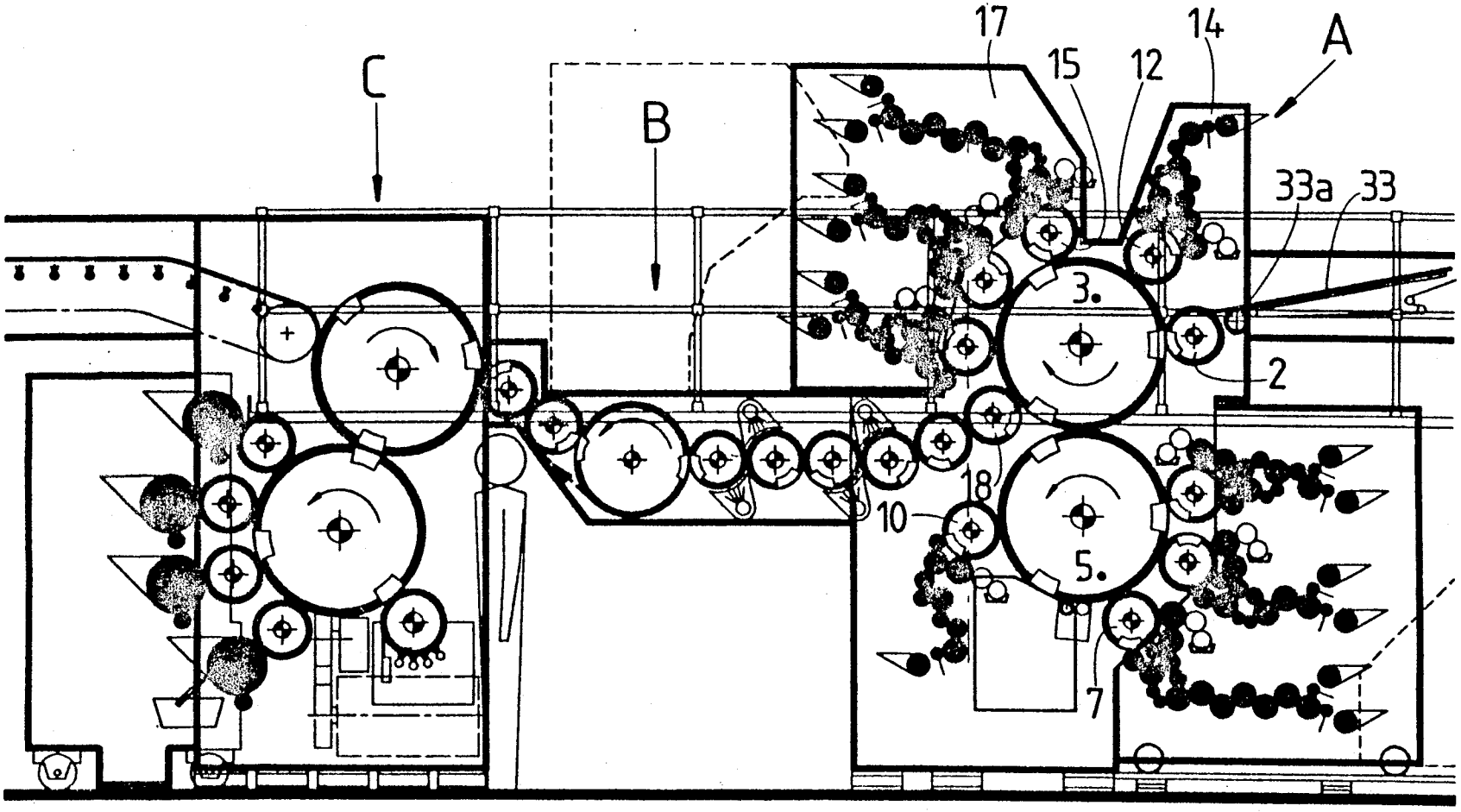
FIG. 2 shows an alternative version of the printing machine according to FIG. 1 with another sheet-feed system and another arrangement of the plate cylinders on the upper blanket cylinder of the indirectly printing printing unit.

The printing machine according to FIG. 2 differs from that according to FIG. 1 in that the transport drums 1 according to FIG. 1 are replaced by another known sheet-feed system 33, for example by sheet transport bands. At the end of this sheet transport system 33, the sheets pass via a stop drum 33*a* and a carry-over drum 2 onto the blanket cylinder 3. A further difference from the printing machine according to FIG. 1 is that only one plate cylinder 12 with its inking unit is installed in the upper inking-unit stand 14 of the indirectly printing printing unit A, but instead three plate cylinders 15 with their inking units are installed in the other inking-unit stand 17. In this printing machine, that circumferential region of the blanket cylinder 3 over which a sheet passes extends over an angle of approximately 145°. All the remaining components of the indirectly printing printing unit A, of the sheet transport device B and of the intaglio printing unit C are the same as in the exemplary embodiment according to FIG. 1.

Figure 3:
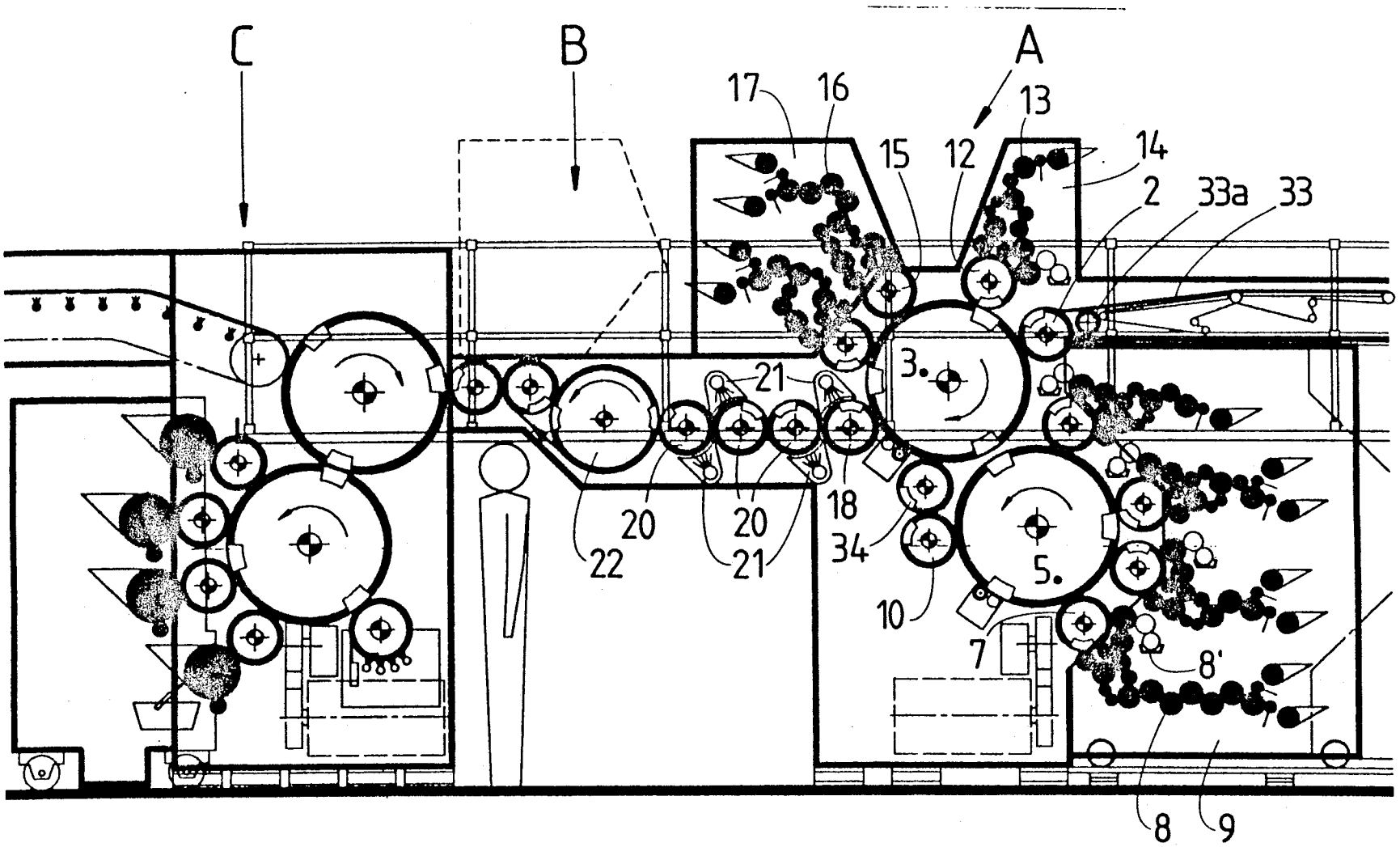
FIG. 3 shows a second exemplary embodiment, in which the indirectly printing printing unit provides a multicolor offset print on one sheet side and a color collect print on the other sheet side.

In the printing machine according to the exemplary embodiment shown in FIG. 3, the lower half of the indirectly printing printing unit A prints by the collect printing process, also called the Orlof process, whereas the upper half prints by the offset printing process, as in the example according to FIGS. 1 and 2. The sheet-feed system 33 with the stop drum 33*a*, from which the sheets pass onto the carry-over drum 2, corresponds to that of the printing machine according to FIG. 2. In the sheet transport device B, in front of the sheet-turning drum 22 there are only four small transport drums, namely the transfer drum 18 and the following three drums 20, drying devices 21 being arranged in circumferential proximity to all four small drums.

The remaining parts of the sheet transport device B and the intaglio printing unit C correspond to the exemplary embodiments according to FIGS. 1 and 2.

To execute a color collect print on one sheet side, the lower half of the indirectly printing printing unit A according to FIG. 3 is designed as follows:

The two blanket cylinders 3 and 5 are moved away from one another. The plate cylinder 10 resting against the blanket cylinder 5 carries a collect printing plate having a complete printing design. Between this plate cylinder 10 and the blanket cylinder 3 there is an additional small cylinder in the form of an image transfer cylinder 34 which rests both against the plate cylinder 10 and against the blanket cylinder 3. Arranged on the right of the vertical center line of the blanket cylinder 5, according to FIG. 3, are four plate cylinders 7 carrying color selector plates which are inked with different colors by inking units 8. Furthermore, once again, in each inking unit 8 there is a dampening unit 8' which, when a wet-offset printing plate is used, dampens this.

The color selector plates have cut out reliefs which are respectively inked and correspond to those regions of the collect printing plate to be printed in a specific color and which transfer a multicolor image, with colors lying next to one another, onto the blanket cylinder 5 functioning as a color collect cylinder and itself inking the collect printing plate on the plate cylinder 10. The multicolor image of this inked collect printing plate is transferred, by means of the image transfer cylinder 34, onto the sheet which runs through between the blanket cylinder 3 and image transfer cylinder 34. The collect printing plate is preferably composed of a typographic printing plate, but can also be composed of a wet-offset printing plate, in which case this printing plate is dampened by a dampening unit which, as seen in the direction of rotation of the plate cylinder 10, is located behind the point of touch contact with the image transfer cylinder 34 and in front of the point of touch contact with the blanket cylinder 5.

So that the image transfer cylinder 34 can be accommodated easily on the circumference of the blanket cylinder 3, the blanket cylinder 5 is arranged somewhat offset outwards, that is to say somewhat to the right according to FIG. 3, in relation to the blanket cylinder 3 located above it. As a result of this, on the circumference of the blanket cylinder 5, to the right of its vertical center line, there is space for the installation of four plate cylinders 7 carrying color selector plates, so that in this exemplary embodiment the blanket cylinder 5 interacts with five plate cylinders altogether.

Because of this configuration, the sheet feed to the blanket cylinder 3 is offset somewhat upwards in relation to the printing machines according to FIGS. 1 and 2, and therefore that circumferential region of the blanket cylinder 3 over which a sheet runs and which is located between the carry-over drum 2 and transfer drum 18 is somewhat larger; in the example under consideration, it is equal to half the cylinder circumference, but if appropriate could also be made somewhat smaller directly. In the upper free circumferential region of the blanket cylinder 3 there are three plate cylinders, namely, on the right of the vertical center line, a plate cylinder 12 with its inking unit 13 in the inking-unit stand 14 and, on the left of the vertical center line, two plate cylinders 15 with their inking units 16 in the inking-unit stand 17.

Thus, the sheets, when they run through the nip between the blanket cylinder 3 and image transfer cylinder 34, acquire a three-color offset print on one side and a four-color collect print on the other side. Safety backgrounds can consequently be produced in this way on both banknote sides by different printing processes, the offset printing process providing images with superposed colors and the collect printing process images with colors lying next to one another.

Figure 4:
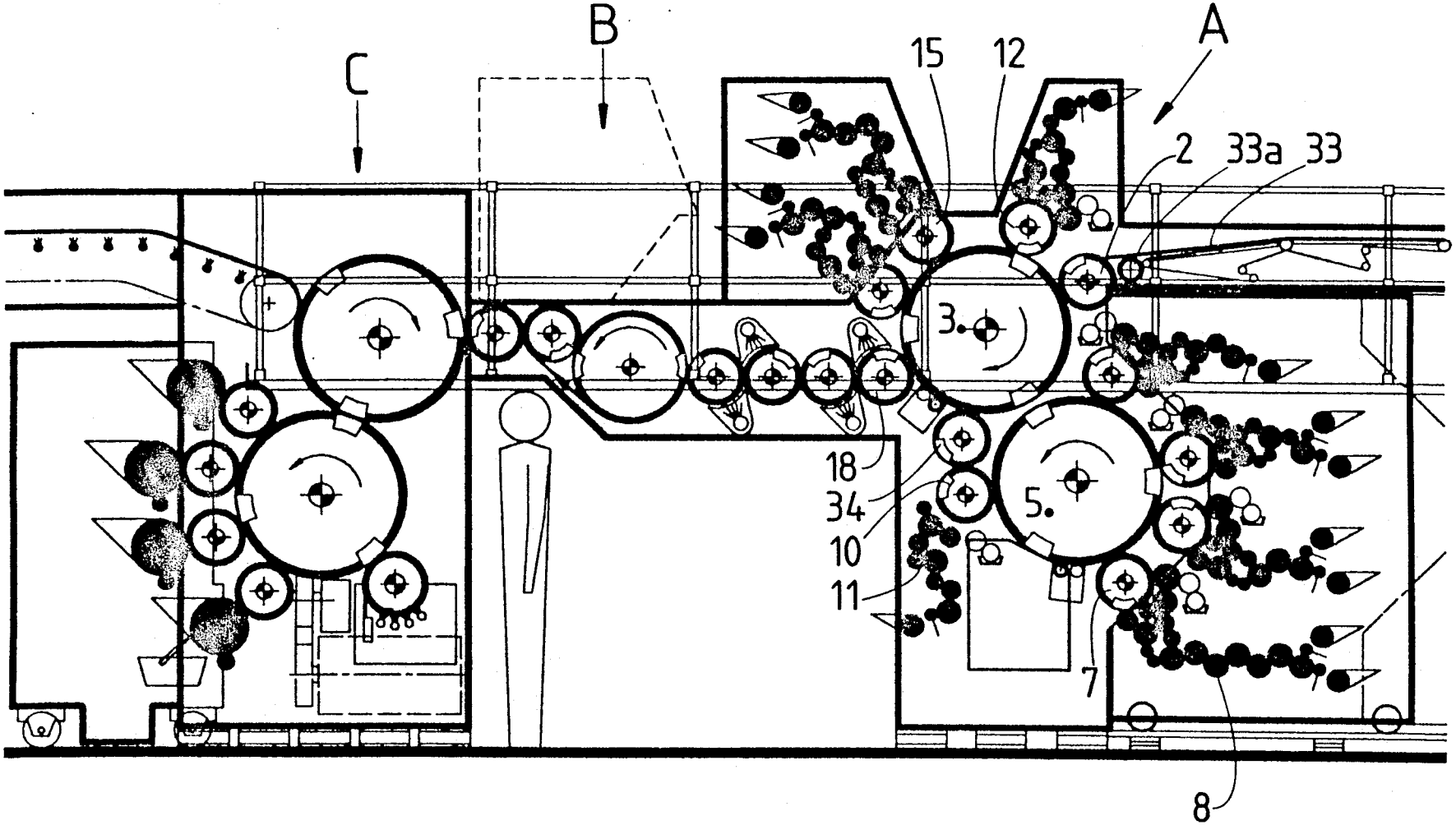
FIGS. 4 to 6 show a third exemplary embodiment, in which the indirectly printing printing unit is convertible and can assume three different working positions for obtaining different print combinations, the lower printing-unit half according to FIG. 4 assuming a collect printing position, according to FIG. 5 a first offset printing position and according to FIG. 6 a second offset printing position.
Figure 5:
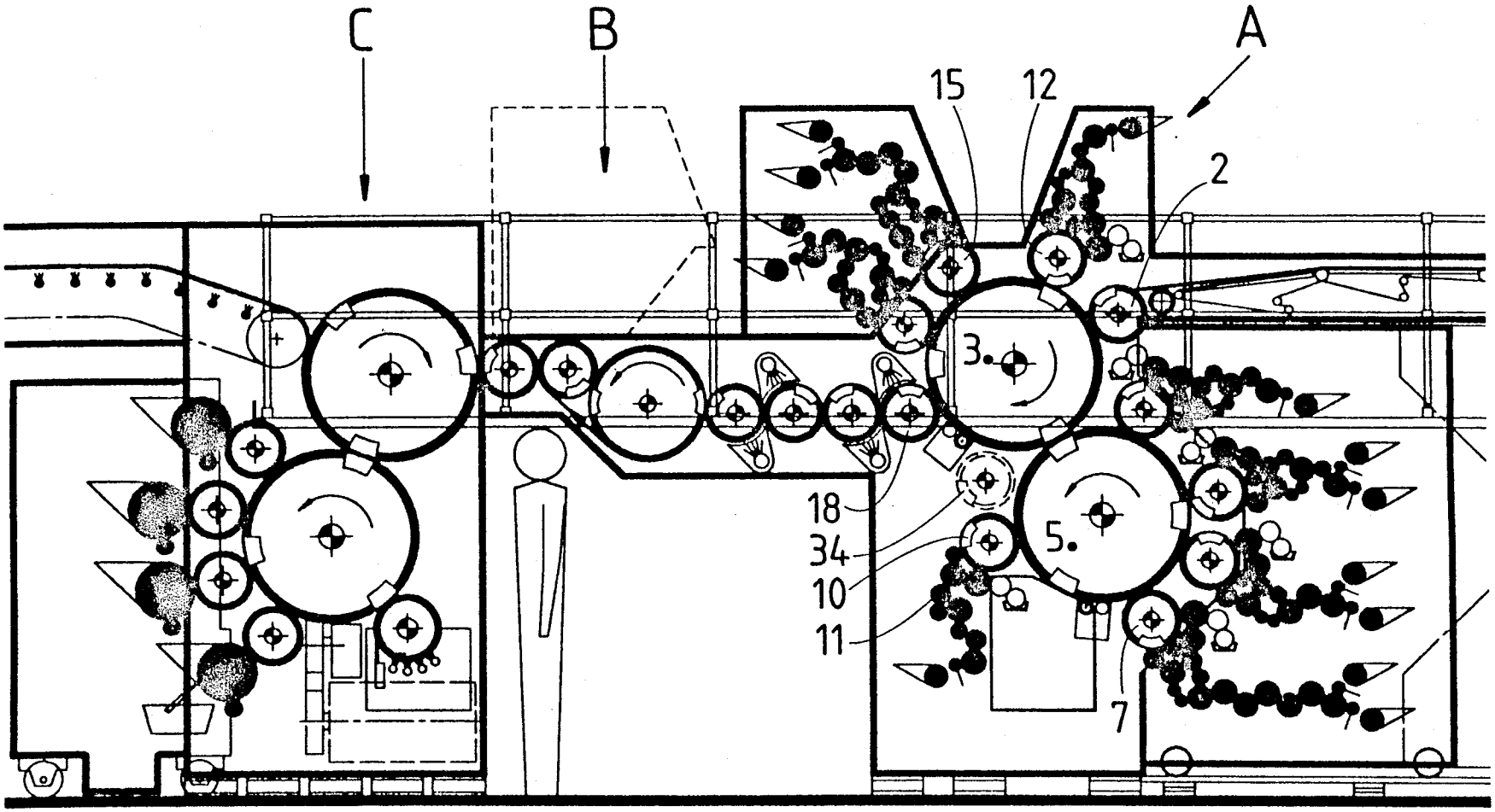
Figure 6:
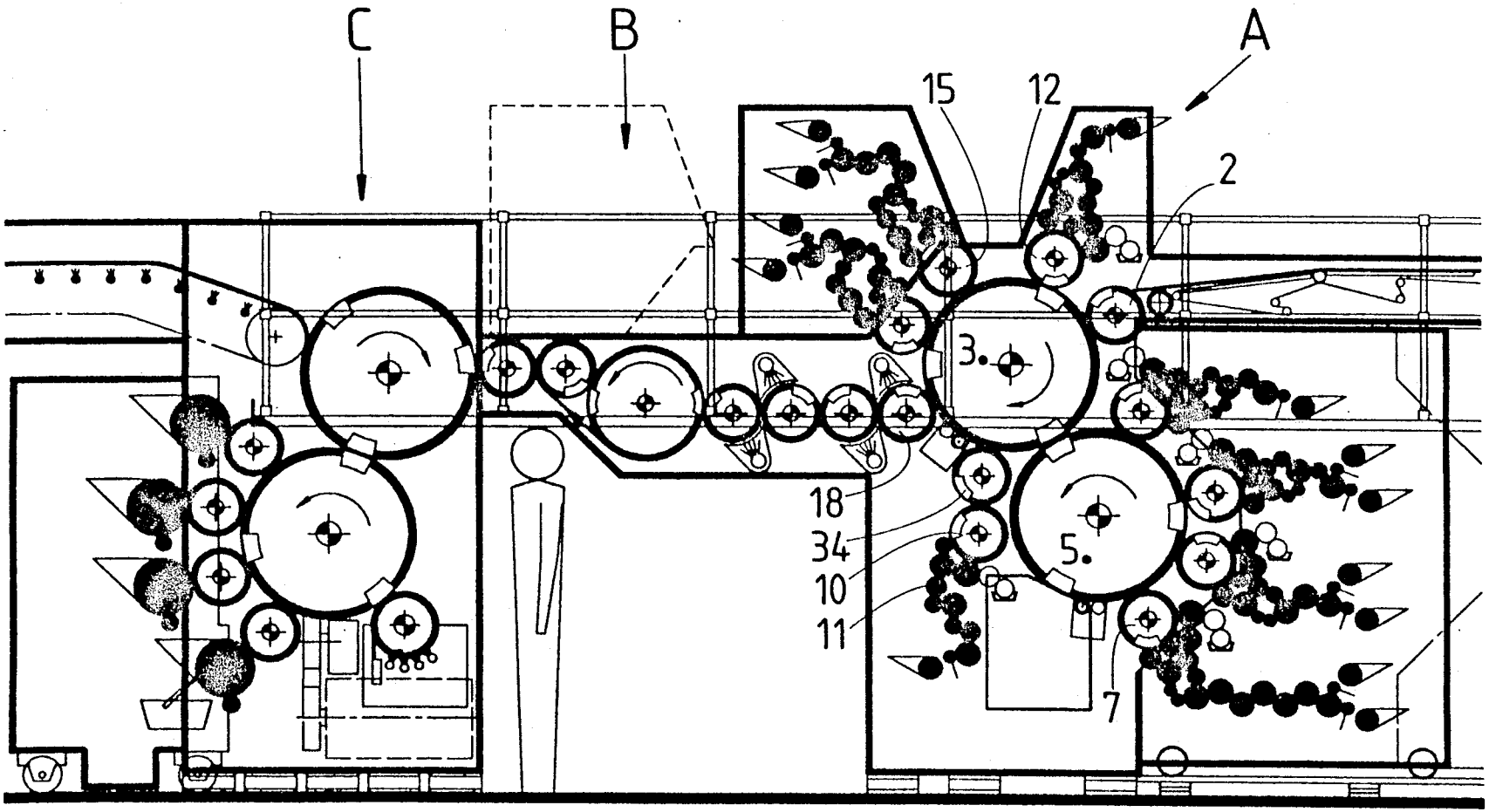

FIGS. 4 to 6 illustrate a further exemplary embodiment of a printing machine, in which the indirectly printing printing unit A is convertible and can assume three different printing positions. The printing machine according to FIGS. 4 to 6 has the same sheet transport device B, the same intaglio printing unit C and an essentially identically constructed printing unit A as the printing machine already described according to FIG. 3. Like parts are designated by the same reference symbols.

The differences are that the blanket cylinder 5 is adjustable between an offset printing position (FIGS. 5 and 6) and a collect printing position (FIG. 4), that the image transfer cylinder 34 is adjustable between a working position, in which it rests both against the blanket cylinder 3 and against the plate cylinder 10, and an inoperative position moved away from these two cylinders, that the plate cylinder 10 is likewise adjustable, has an associated inking unit 11 and carries either an offset printing plate (FIGS. 5 and 6) or a collect printing plate (FIG. 4), and finally that the plate cylinders 7 touching the blanket cylinder 5 carry either offset printing plates (FIGS. 5 and 6) or color selector plates (FIG. 4).

The sheet-feed system 33 with the stop drum 33*a* is the same as in the printing machine according to FIG. 3. The blanket cylinder 5 is assigned, in addition to the plate cylinder 10 with its inking unit 11, once again four plate cylinders 7 with their inking units 8 which are located on the right of the vertical center line of the blanket cylinder 5. Once more, as in the printing machine according to FIG. 3, the blanket cylinder 3 is inked by three plate cylinders 12 and 15 carrying offset plates.

In the collect printing position according to FIG. 4, the blanket cylinder 5 is moved away from the blanket cylinder 3; the plate cylinder 10 carries the collect printing plate having a complete printing design, rests against the blanket cylinder 5 and is separated from the inking unit 11 assigned to it, this being obtainable in the simple way, for example, by setting back the adjacent inking rollers or transfer rollers. The image transfer cylinder 34 assumes its working position. The four plate cylinders 7 carry color selector plates. The collect printing position according to FIG. 4 and the collect printing image produced correspond exactly to the configuration of the printing machine described according to FIG. 3 and the collect printing image obtained there.

In the offset printing position according to FIG. 5, the blanket cylinder 5 is pressed against the blanket cylinder 3, as in the printing machine according to FIG. 1; the plate cylinder 10 carries an offset printing plate inked by the applied inking unit 11, rests against the blanket cylinder 5 and inks this. The plate cylinders 7 are likewise equipped with offset printing plates. The image transfer cylinder 34 assumes its inoperative position, in which it is moved away both from the plate cylinder 10 and from the blanket cylinder 3. In this case, the sheet passing through the nip between the impression cylinders 3 and 5 is given a three-color offset print on its upper side and a five-color offset print on its lower side.

FIG. 6 shows a further offset printing position of the printing unit A, in which the blanket cylinders 3 and 5 are once again pressed against one another, but the plate cylinder 10 is moved away from the blanket cylinder 5 and interacts with the image transfer cylinder 34 which assumes its working position and which is pressed against the blanket cylinder 3. The plate cylinder 10 carries an offset printing plate which is inked by the applied inking unit 11 and the image of which is transferred onto the sheet by means of the image transfer cylinder 34. The four plate cylinders 7 carry offset printing plates which ink the blanket cylinder 5. A sheet thus, in the nip between the blanket cylinders 3 and 5, first receives a three-color offset print on its upper side and a four-color offset print on its lower side and thereafter receives a further single-color offset print on its lower side by means of the image transfer cylinder 34.

The invention is not restricted to the exemplary embodiments described, but offers the possibility of many alternative versions, especially as regards the number and exact arrangement of the plate cylinders interacting with the blanket cylinders 3 and 5, the design of the sheet transport device composed of drums and the design of the intaglio printing unit.

I claim:

1. A combined sheet-fed rotary printing machine having an indirect printing unit (A) which includes a first cylinder (5) comprising a first blanket cylinder, a plurality of plate cylinders (7, 10), a second cylinder (3) of substantially the same size as the first cylinder, a sheet transport device (B) for use in association with the printing unit (A), said sheet transport device comprising a plurality of transport drums, drying means (21) positioned along the sheet transport device, and an intaglio printing unit (C) for use in association with the sheet transport device, wherein said second cylinder (3) interacts with a carry-over drum (2) for feeding sheets, a transfer drum (18) for receiving sheets comprising a first transport drum of the sheet transport device, said second cylinder having a circumferential region located between the carry over drum and the transfer drum and against which a sheet rests, facing the first blanket cylinder (5), a multicolor image originating from the plate cylinders (7, 10) is transferred onto a side of a sheet facing said first blanket cylinder, said second cylinder (3) comprising a second blanket cylinder said circumferential region is at most equal to half the said second blanket cylinder's circumference, and along said circumferential region of said second blanket cylinder (3) which is not covered by a sheet are a plurality of second plate cylinders (12, 15) adjacent said second blanket cylinder such that a multicolor image originating from said second plate cylinders (12, 15) is transferred onto an opposite side of the sheet and said transfer drum (18), carry-over drum (2) and said first and second plate cylinders (7, 10, 12, 15) are of substantially the same size.

2. The sheet-fed rotary printing machine as claimed in claim 1, wherein said sheet transport device includes a plurality of transport drums (19, 20) in addition to the first transfer drum (18) which are substantially of the same size, and drying devices (21) are provided and arranged in circumferential proximity to at least two successive transport drums.

3. The sheet-fed rotary printing machine as claimed in claim 1, which includes a plurality of additional transport drums (1) of approximately the same size for feeding the sheet, are arranged in front of the carry-over drum (2), and wherein fluff suck off devices (32) are provided in circumferential proximity to at least two successive ones of said additional transport drums.

4. The sheet-fed rotary printing machine as claimed in claim 1, wherein the two blanket cylinders (3, 5) of the indirect printing printing unit (A) are located at least approximately vertically above one another, and the carry-over drum (2), the transfer drum (18) and the transport drums (19, 20) located behind this are arranged at least approximately horizontally next to one another.

5. The sheet-fed rotary printing machine as claimed in claim 1, which includes within the sheet transport device a sheet-turning device having a sheet-turning drum (22) and a register-monitoring device having a register drum (22) for correcting the register and functioning as a transport drum.

6. The sheet-fed rotary printing machine as claimed in claim 1, wherein the second blanket cylinder (3) of the indirect printing printing unit (A) is located above the first blanket cylinder (5), and the plate cylinders (7, 10, 12, 15) assigned to the first and the second blanket cylinder are arranged respectively on both sides of the vertical center line of the respective blanket cylinder.

7. The sheet-fed rotary printing machine as claimed in claim 1, wherein the circumferential region of the second blanket cylinder (3) located between the carry-over drum (2) and transfer drum (18) and over which runs a sheet extends over less than 150°.

8. The sheet-fed rotary printing machine as claimed in claim 1, wherein, in the indirect printing printing unit (A), the plate cylinders (12, 15) touching the second blanket cylinder (3) carry offset printing plates and are in touch with said first blanket cylinder, all the plate cylinders each being inked with a different color by a respective inking unit (8, 11; 13, 16), and wherein the two blanket cylinders (3, 5) are pressed against one another, the sheets guided through between the first and second blanket cylinders acquiring a multicolor offset print simultaneously on both sides.

9. The sheet-fed rotary printing machine as claimed in claim 1, wherein, in the indirect printing printing unit (A), the plate cylinders (12, 15) touching the second blanket cylinder (3) carry offset printing plates which are each inked with a different color by a respective inking unit (13, 16), wherein all the plate cylinders (7, 10) assigned to the first blanket cylinder (5) are in touch with said first blanket cylinder, wherein one (10) of these plate cylinders carries a collect printing plate, whilst the remaining plate cylinders (7) carry color selector plates each inked by an inking unit (8), wherein the two blanket cylinders (3, 5) are moved away from one another, and wherein the plate cylinder (10) carrying the collect printing plate interacts with an image transfer cylinder (34) which is pressed against the second blanket cylinder (3), the sheets guided through between the second blanket cylinder (3), and the image transfer cylinder (34) acquiring simultaneously a multicolor offset print on one side and a color collect print on the other side.

10. The sheet-fed rotary printing machine as claimed in claim 1, wherein, in the indirect printing printing unit (A), all the plate cylinders (7, 10) assigned to the first blanket cylinder (5) and all the plate cylinders (12, 15) touching the second blanket cylinder (3) carry offset printing plates and are each inked by a respective inking unit (7, 11; 13, 16), wherein one (10) of the plate cylinders assigned to the first blanket cylinder (5) is moved away from said first blanket cylinder, whilst all the remaining plate cylinders (7) are in touch with said first blanket cylinder, wherein the two blanket cylinders (3, 5) are pressed against one another, and wherein the plate cylinder (10) moved away from the first blanket cylinder (5) interacts with an image transfer cylinder (34) which is itself pressed against the second blanket cylinder (3), the sheets guided through between the two blanket cylinders (3, 5) acquiring simultaneously a multicolor offset print on both sides and, during the passage through between the second blanket cylinder (3) and the image transfer cylinder (34), an additional single-color offset print on one side.

11. The sheet-fed rotary printing machine as claimed in claim 1, wherein, in the indirect printing printing unit (A), the first blanket cylinder (5) is adjustable between an offset printing position pressed against the second blanket cylinder (3) and a collect printing position moved away from said second blanket cylinder, wherein one (10) of the plate cylinders assigned to the first blanket cylinder (5) is adjustable between a position resting against said first blanket cylinder (5) and a position moved away from said first blanket cylinder (5) wherein arranged between said one adjustable plate cylinder (10) and the second blanket cylinder (3) is an image transfer cylinder (34) which is adjustable between a working position, in which it touches said second blanket and adjustable plate cylinders (3, 10) and in which it transfers the color image originating from the adjustable plate cylinder (10) onto the sheet resting against the second blanket cylinder (3), and a moved-away inoperative position, wherein, in the collect printing position, all the plate cylinders (7, 10) assigned to the first blanket cylinder (5) rest against said first blanket cylinder, the adjustable plate cylinder (10) carries a collect printing plate and is separated from the inking unit (10) assigned to it, the remaining plate cylinders (7) carry color selector plates each inked by an inking unit (8), and the image transfer cylinder (34) assumes its working position, and wherein all the plate cylinders (7, 10) assigned to the first blanket cylinder (5) carry offset printing plates each inked by a respective inking unit (8, 11), and the adjustable plate cylinder (10) either rests against the first blanket cylinder (5) and inks this, whilst the image transfer cylinder (34) assumes its moved-away inoperative position, or is moved away from the first blanket cylinder (5), whilst the image transfer cylinder (34) assumes its working position.

* * * * *